US005123867A

United States Patent [19]

Broinowski

[11] Patent Number: 5,123,867

[45] Date of Patent: Jun. 23, 1992

[54] MARINE JET PROPULSION UNIT

[76] Inventor: Stefan Broinowski, P.O. Box 368, Edgecliff, NSW 2027, Australia

[21] Appl. No.: 521,696

[22] Filed: May 10, 1990

[51] Int. Cl.[5] ..... B63H 11/113

[52] U.S. Cl. ..... 440/42; 440/38

[58] Field of Search ..... 440/38–42, 440/46, 47, 88; 60/221, 222; 415/118

[56] References Cited

U.S. PATENT DOCUMENTS

| | | | |
|---|---|---|---|
| 3,187,708 | 6/1965 | Fox | 115/12 |
| 3,192,715 | 7/1965 | Engle et al. | 60/35 |
| 3,233,573 | 2/1966 | Hamilton | 440/47 X |
| 3,302,605 | 2/1967 | Kuether | 440/42 |
| 3,589,325 | 6/1971 | Tattersall | 115/12 R |
| 3,593,713 | 12/1971 | Slade | 60/221 X |
| 3,598,808 | 8/1971 | Shields | 115/14 |
| 3,620,019 | 11/1971 | Muente | 60/221 |
| 3,624,737 | 11/1971 | Keller | 115/12 R |
| 3,680,315 | 8/1972 | Aschauer et al. | 60/221 |
| 3,776,173 | 12/1973 | Horwitz | 115/12 R |
| 3,782,320 | 1/1974 | Groves | 115/12 R |
| 3,788,265 | 1/1974 | Moore | 115/12 R |
| 3,827,390 | 8/1974 | DeVault et al. | 60/221 X |
| 3,842,787 | 10/1974 | Giacosa | 115/16 |
| 3,868,833 | 3/1975 | Noe et al. | 440/38 X |
| 3,889,623 | 6/1975 | Arnold | 440/39 |
| 3,993,015 | 11/1976 | Klepacz et al. | 115/14 |
| 4,133,284 | 1/1979 | Holcroft | 440/88 |
| 4,432,736 | 2/1984 | Parramore | 440/42 |
| 4,449,944 | 5/1984 | Baker et al. | 440/47 |
| 4,474,561 | 10/1984 | Haglund | 440/38 X |
| 4,600,394 | 7/1986 | Dritz | 440/38 |
| 4,643,685 | 2/1987 | Nishida | 440/42 |
| 4,652,244 | 3/1987 | Drury | 440/140 |
| 4,718,870 | 1/1988 | Watts | 440/38 |
| 4,925,408 | 5/1990 | Webb et al. | 440/38 |

FOREIGN PATENT DOCUMENTS 249788 11/1988 Australia .

*Primary Examiner*—Ed Swinehart

*Attorney, Agent, or Firm*—Daniel N. Lundeen; Andrew S. Pryzant

[57] ABSTRACT

A jet propulsion unit is provided for marine craft where a stream of water is induced in a converging inlet section and delivered as a steady laminar shaped flow regime to an impeller section whose novel impeller/diffuser vane combination and converging annular volume enables operation of the vessel over a wide range of speeds and sea conditions without cavitation. Acceleration of water energized by the impeller through an interchangeable nozzle provides additional thrust and maneuverability. The propulsion unit additionally incorporates an arm-hole duct in the inlet housing for easy clean-up of any fouling and a bypass valve positioned upstream from the impeller to eliminate balling and drag caused thereby.

22 Claims, 6 Drawing Sheets

MARINE JET PROPULSION UNIT

FIELD OF THE INVENTION

The present invention is directed to a marine jet propulsion apparatus, and more particularly to an impeller assembly for a marine jet propulsion unit

BACKGROUND OF THE INVENTION

The use of jet propulsion devices for marine craft is well known technology. Jet propulsion has many advantages over the simple propeller, particularly in terms of maneuverability, and jet propulsion energy consumption is much more efficient. However, widespread acceptance of jet propulsion for marine craft has not occurred because of certain common problems associated with marine jet propulsion. For example, marine jet propulsion poses significant design problems because of uncertain performance over a wide range of speeds, water depth, sea conditions, etc.

Excess water pickup at the jet propulsion unit inlet may cause balling, i.e., excess water pressure between the hull and the inlet because the unit is not able to intake a sufficient volume of water during craft maneuvers or poor sea conditions. Balling induces a high drag characteristic adversely affecting the propulsive efficiency. Cavitation is another common problem. Cavitation represents an uneven load on the impeller. Cavitation can be produced by excessive radial acceleration of the fluid, excess swirl and turbulence of the fluid column, and unintentional partial vaporization of the fluid throughput associated with a vacuum produced by impeller action.

Accordingly, it would be desirable to design a jet propulsion unit for marine vessels where each feature synergistically work together to provide for a constant column of water even at high output and where the water throughput is neither turbulent nor swirling in order to eliminate cavitation effects. Furthermore, the unit should have maximum flexibility to cope with the entire speed range of the marine vessel and varying loading on the unit without producing the above-mentioned balling and cavitation effects.

Finally, the unit ought to be efficient at preventing intake of foreign matter, yet have provided therefor a quick means for manually cleaning the intake if fouling occurs.

U.S. Pat. No. 3,187,708 to Fox discloses a housing unit for boats that supplants the gear box propeller and rudder structure of the usual power boat arrangements The jet unit is entirely outside of the boat hull and the construction of the housing is arranged so that the outside shell of the unit is very smooth and has a minimum of projections thereon which might engage and snag on objects in the water. The forward and reverse mechanism consists of a balance deflector damper within the discharge nozzle.

U.S. Pat. No. 3,192,715 to Engel, et al. discloses a steering device for a jet propelled water craft. The steering device is provided with a control system.

U.S. Pat. No. 3,302,605 to Kuether discloses a rudder jet propulsion apparatus for water craft having a water inlet in the hull, an impeller connected to a motor means, and an outlet in the form of a nozzle. The intake is provided with a rotary weed cutting device that is operated by the drive means for the impeller. A clutch may be used for optionally coupling and uncoupling the weed cutting device from the drive means.

U.S. Pat. No. 3,598,808 to Shields discloses a marine propulsion device providing a semi-submerged supercavitating propeller rotating coaxially with water jet-producing impellers mounted on the same shaft.

U.S. Pat. No. 3,620,019 to Munte discloses a jet propulsion drive having an upright housing at the rear end of a water craft and a cross-sectional outline resembling a symmetrical trapezium. The narrowest side of the housing faces oppositely the extended movement of the water craft and a pair of side walls extend from the narrow side in the direction of intended movement. Inlet means are provided for admitting water into the housing and outlet means are in the narrow side for expelling water from the housing. An expeller vane is mounted in the housing for pivotal movement immediate the respective side walls about an upright axis extending through the housing in the region of the outlet means.

U.S. Pat. No. 3,624,737 to Keller discloses an underwater jet propulsion nozzle including means for injecting air into the jet stream issuing from the nozzle to give increased thrust when stationary or at low speeds. The nozzle is mounted for swiveling movement on a fixed jet pipe and the plane of the swivel joint is inclined downwards in the direction of forward motion.

U.S. Pat. No. 3,842,787 to Giacosa discloses a water jet impeller unit of the type comprising a duct along which water forced by means of a motor driven propeller housed in the duct in which there is provided a deflector nozzle at the downstream of the duct which is pivoted about a substantially vertical hinge axis. The deflector nozzle has a main nozzle outlet facing rearwardly and two subsidiary nozzle outlets facing forwardly and diverging outwardly, the subsidiary nozzle outlets are variable in size by virtue of their cooperation with the size of the duct so that as the nozzle turns about its hinges, one of the subsidiary outlets becomes enlarged while the other diminishes. The nozzle also carries a baffle at the main outlet thereof which is moveable between an open position where it allows water to flow out through the main nozzle outlet, and a closed position where it forces water to flow through the subsidiary outlets to provide a reverse thrust which can be adjusted by inclination of the nozzle about its hinged axis.

U.S. Pat. No. 4,652,244 to Drury discloses a stream of water is caused to move through a duct carried within the hull of a water craft and discharge as a jet in a direction which is nondirectional to the craft. The jet is redirected, as by a plate or nozzle to impart movement to the craft in a selected direction.

U.S. Pat. No. 4,643,685 to Nishida discloses a water jet propelled craft equipped in the rear section of the craft with a water jet pump driven by an engine. The rear end of a nozzle of the water jet pump has an outlet for exhaust gas from the engine.

U.S. Pat. No. 4,718,870 to Watts discloses a marine propulsion water jet system which includes a fluid flow amplifier by which a high velocity principal water flow is injected into a slower velocity secondary water flow to form a water jet. The fluid flow amplifier includes an adjustable orifice to which the principal water flow the orifice is automatically adjusted in order to maintain a relatively constant water jet velocity.

U.S. Pat. No. 4,600,394 to Dritz discloses a marine propulsion unit which is designed for intensifying the thrust obtained by an impeller such as a propeller for standard outboard or inboard/outboard marine propulsion systems. The unit design incorporates an axial flow or screw type impeller operating within a housing which terminates in an area of reduced cross-sectional which augments the thrust delivered by the impeller. The impeller blades virtually abut the inner circumference and fill the cross-sectional area of the housing near the inlet port.

U.S. Pat. No. 3,776,173 to Horwitz discloses a propulsion system for a boat that not only provides forward movement and directional control, but also provides means for controlling the attitude of the boat. The control system uses a jet nozzle mounting structure that permits the nozzle to pivot in a horizontal direction and/or in a vertical direction Australian Patent Application 24907/88, filed Nov. 1, 1988 and opened to public inspection May 11, 1989, discloses a marine propulsion unit comprising a housing with a variable inlet induction, first set of vanes downstream of said induction, a propeller/impeller, a second set of vanes downstream of said propeller and a convergent discharge housing downstream of said second set of vanes. The use of a variable inlet orifice induction is said to reduce choking within the induction, and therefore cavitation and drag. The marine propulsion unit may be used with either outboard or sterndrive power trains.

U.S. Pat. No. 3,589,325 to Tattersil discloses a marine craft fitted with a water jet propulsion unit having a rudder disposed adjacent the outlet of the unit so as to influence the direction taken by water discharged by the outlet. The rudder is pivotable about an axis passing through the plane of its surface and the outlet of the unit.

U.S. Pat. Nos. 3,782,320 to Groves and 3,788,265 to Moore disclose a control assembly for a boat having a water jet propulsion system in which the jet is discharged successively through a discharge conduit and nozzle. The nozzle is moveable with respect to the conduit and is provided with a moveable bucket whereby the nozzle and bucket are moveable into different positions of adjustment to control the jet, and thus control the steering, fore and aft movements and the desired planing of the boat.

U.S. Pat. No. 4,432,736 to Parramore discloses a steering mechanism for a water jet propelled craft having a rotatable propulsion nozzle. The mechanism comprises controls which rotate the nozzle via a differential gear box. The steering control is operative to rotate a gear box input shaft via a worm and pinion reduction gear and the reversal control is operable to rotate the cage. The nozzle is connected to a gear box output of the shaft.

U.S. Pat. No. 3,993,015 to Klepacz et al. discloses a hydraulic propulsion for water craft involving the forming of a parallel-sided, open-ended inlet intake tunnel with a recessed intake screen which directs the incoming water into a single or multistaged cylindrical axial pump having multivaned matched impellers and straighteners for driving the flow into an unobstructed acceleration chamber which converges the flow and discharges it as a jet through a cylindrical opening with controls thereat to propel and steer the craft.

SUMMARY OF THE INVENTION

The present invention provides a jet propulsion unit for disposition in the rear of marine craft to be propelled. The unit includes an impeller assembly enabling the unit to operate over a wide variety of conditions associated with speed variation, maneuverability, and sea conditions without cavitation or balling.

The jet propulsion unit for a marine craft comprises an intake section for receiving water from adjacent the unit; an impeller section for increasing the energy of water from said intake section; and a diffuser section for promoting axial flow of the water from the impeller section. The discharge section is swivelable for discharging water from the diffuser section as a directional water jet. Disposed in the impeller section is a cylindrical housing having an inner surface of generally uniformed diameter. Concentrically disposed in the cylindrical housing is a rotatable hub having an outer surface tapered outwardly from a minimum outside diameter adjacent the intake section to a maximum outside diameter adjacent the diffuser section. A plurality of radially spaced impeller blades are affixed on the rotatable hub and extend outwardly from the hub outer surface to adjacent the cylindrical housing inner surface. The blades are inclined at an angle with respect to a plane containing a longitudinal axis of the rotatable hub. An inside surface disposed in the diffuser section is tapered inwardly from a maximum diameter adjacent the impeller section to a minimum diameter adjacent the discharge section. Concentrically disposed in the diffuser section is a fixed hub having an outside surface tapered inwardly from a maximum diameter adjacent the impeller section to a distal terminus adjacent the discharge section. The outside surface of the fixed hub and the inside surface of the diffuser section define an annulus in the diffuser section having a generally converging cross-sectional area. A plurality of radially spaced diffuser vanes extend from the fixed hub outside surface to the diffuser section inside surface. The diffuser vanes have at least a distal portion parallel to a longitudinal axis of the fixed hub adjacent the discharge section. A bearing is disposed between the rotatable hub and the fixed hub with a means for rotating the rotatable hub with respect to the fixed hub.

The intake passage may have tapered walls converging upon a cylindrical cavity with a transverse inlet cross-sectional area proportional to an inlet cross-sectional area of the impeller section at a ratio of from about 1.5 to about 2.5:1. An arm-hole duct may be provided for gaining a quick access to the inlet passage. The arm-hole duct is, for example, fitted with a plug piece which fills the duct cavity and prevents the duct from impeding flow through the unit where the surface contour of the plug core corresponds to the surface of the adjoining inlet passage. The intake section further comprises one or more straightener vanes securely affixed along an inside contoured surface.

The impeller section may include a bypass valve which is positioned upstream of the impeller blades for inhibiting balling. The cylindrical housing is preferably interchangeable and the impeller section may include a sleeve disposed between the inside diameter of the impeller section and the impeller blades. An outlet cross-sectional area of the diffuser section may be proportional to an inlet cross-sectional area of the impeller section at a ratio of from about 0.50 to about 0.75:1, preferably at a ratio of about 0.60 to about 0.70:1 and optimally about 0.64:1. The maximum outside diameter of the outer surface of the rotatable hub is preferably substantially equivalent to the maximum outside diameter of the outside surface of the fixed hub, however, the rotatable hub is desirably slightly spaced from the fixed hub to present a substantially continuous surface for fluid flow. Preferably, the outer surface of the rotatable hub is convex, more preferably sigmoid. Preferably the outside surface of the fixed hub is convex, more preferably sigmoid. The inside surface of the diffuser section is concave.

In a preferred embodiment, the rotatable hub is mounted on a concentric shaft wherein the shaft is received in a concentric bore formed through the rotatable hub. The shaft has a shoulder engaging a proximal annular end surface of the rotatable hub extending outwardly from the bore to the outer surface adjacent the minimum outside diameter, and the shoulder abuts the rotatable hub to present a smooth, continuous surface for fluid flow. The shaft extends from the rotatable hub into a concentric bore formed in a proximal end of the fixed hub and an annular bearing is disposed between the exterior surface of the shaft extension and an interior surface of the fixed hub bore. The rotatable hub has a distal annular end surface spaced from the proximal annular end surface and extending outwardly from the rotatable hub bore. A locking sleeve having a first end with an outside diameter greater than a minimum diameter of the distal annular end surface is preferably disposed on the shaft extension between the exterior surfaces of the shaft and the annular bearing and engages the distal annular end surface at the first end. The second end of the locking sleeve is engaged by a washer and locking nut. The shaft extension terminates in a threaded projection receiving the locking nut, and the locking nut has a minimum outside diameter less than or equal that of the locking sleeve.

In another preferred embodiment, the discharge section comprises a removeable nozzle attached to a housing by a quick connect fitting. The nozzle is swivelable through 360 degrees and affixed to a discharge end of the nozzle section is a solid ring. The discharge section further comprises one or more straightener vanes securely affixed to a nozzle inner surface and spider vanes attaching the steering means to the discharge section. The outlet cross-sectional area of the discharge section is preferably proportional to an inlet cross-sectional area of the impeller section at a ratio of from about 0.25 to about 0.50:1, preferably at a ratio of about 0.30 to about 0.40:1 and optimally about 0.35:1.

The entire system provides a low resistance flow passage where internal impediments to flow are reduced and the convergent sections are smooth and gradual.

DETAILED DESCRIPTION OF THE INVENTION

Figure 1:
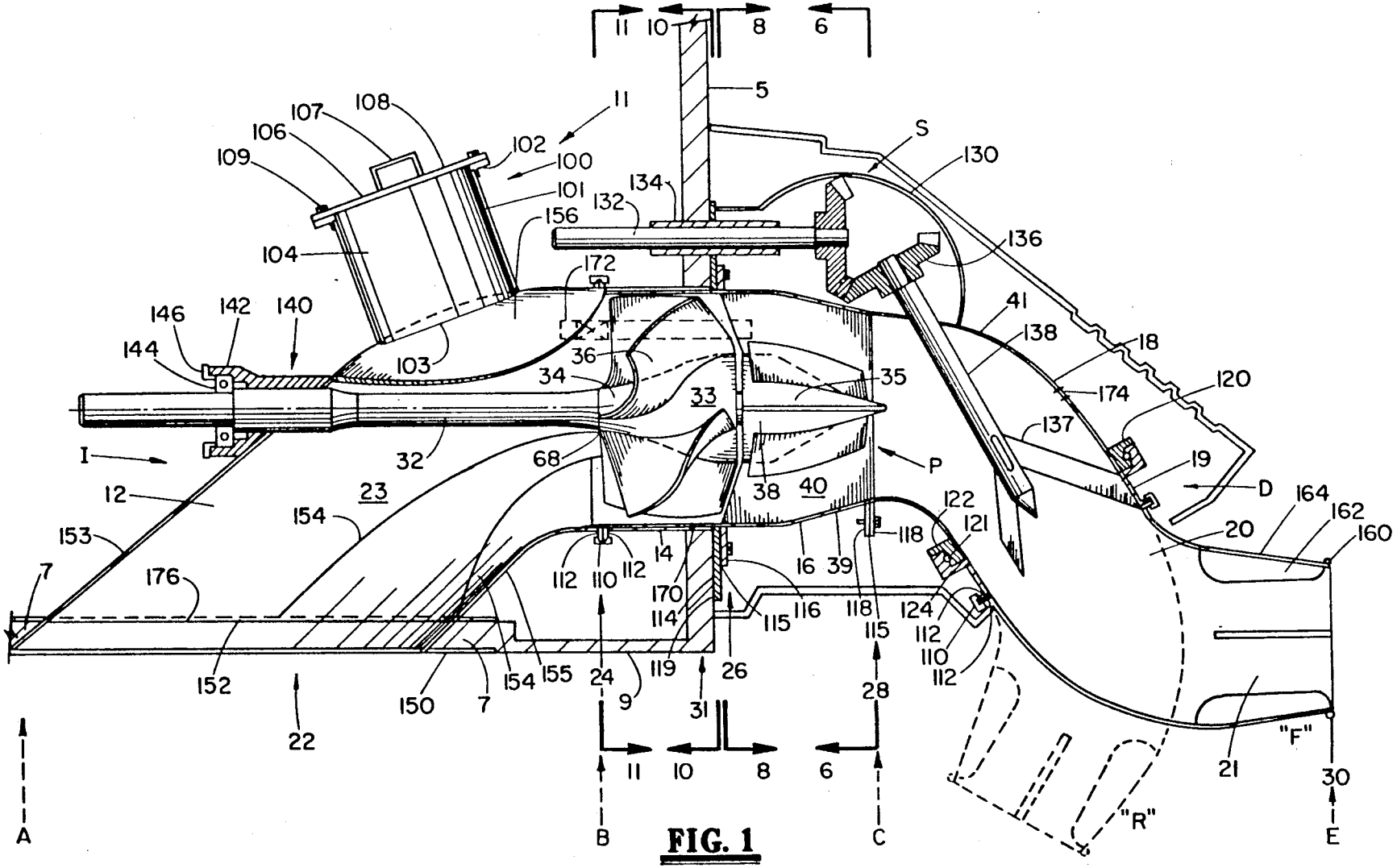
FIG. 1 is a longitudinal cross-section partially cut away showing the marine jet propulsion unit within the confines of a marine vessel in forward thrust position and reverse thrust position.
Figure 2:
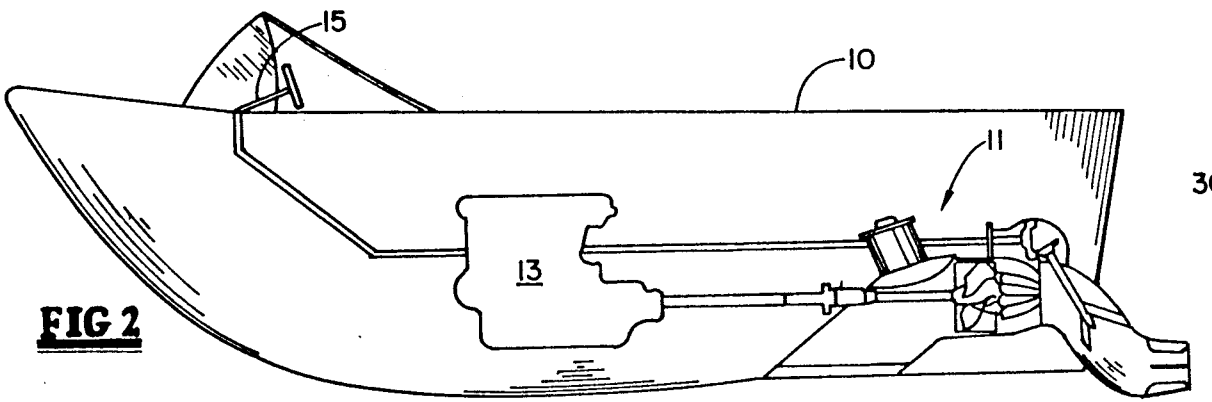
FIG. 2 is a representational view of the jet propulsion unit of the present invention from FIG. 1 in position in a marine craft.

Referring to FIGS. 1-2, the unit 11 functions similarly to an axial flow or turbine pump having an intake section I extending between lines A—A to B—B, an impeller section P extending between lines B—B to C—C and a discharge section D between lines C—C to E—E. A water column induced into inlet passage 23 is energized and accelerated through the discharge section to provide thrust for craft 10.

The marine craft 10 has the jet propulsion unit 11 installed in a rear section so that the intake section I of the unit 11 is incorporated into the bottom hull 9 between mounting blocks 7 and the discharge section D of the unit 11, supported by transom 5, extends out the rear of the boat in place of an ordinary impeller. The unit 11 is shown diagrammatically in two of its thrust positions: F—the forward propulsion position and R the reverse propulsion position. A prime mover 13 is directly attached to an impeller shaft 32 and a steering linkage 15 is attached to the steering means S of the propulsion unit 11.

Figure 4:
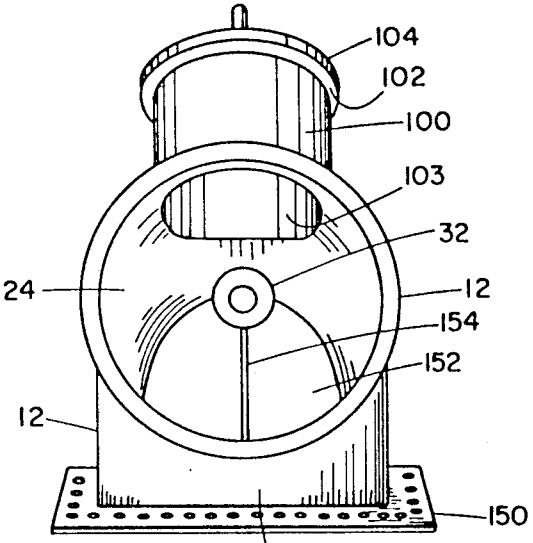
FIG. 4 is a front perspective view of the unit of FIG. 3 along the lines 4—4.
Figure 3:
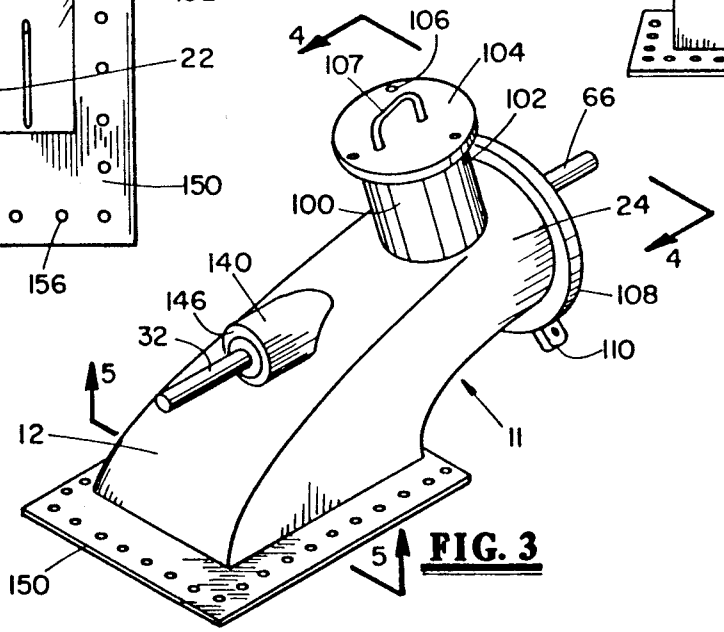
FIG. 3 is an angled exterior perspective view of the intake section of the jet propulsion unit of the present invention.
Figure 5:
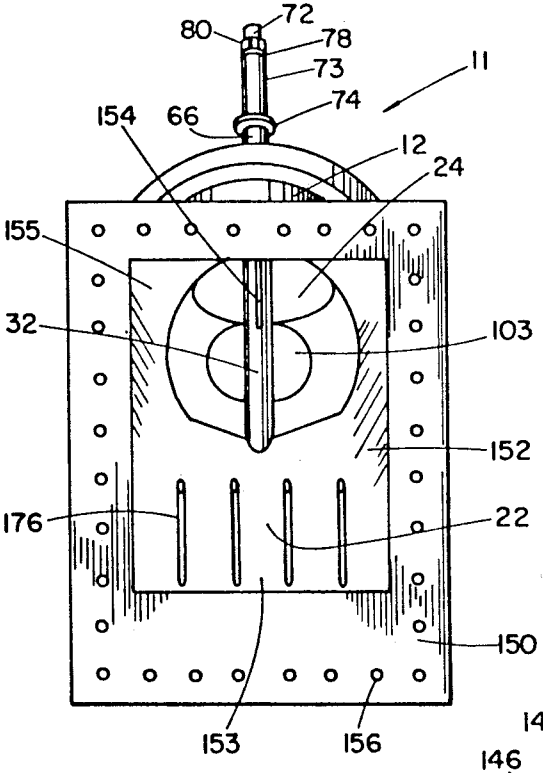
FIG. 5 is a bottom perspective view of the intake section of the jet propulsion unit of FIG. 3 from along the lines 5—5.

Referring to FIGS. 1, 4 and 5, the intake section I more particularly defines an intake passage 23 in a housing 12 communicating between an intake opening 22 formed in the bottom surface of the hull at one end, and the intake 24 to the impeller section P at the other end. Passage 23, initially rectangular, has two vertical walls 152, a long sloping wall 153, and a short sloping wall 155 converging onto a cylindrical chamber at bend 156. Following bend 156, passage 23 is cylindrical. Converging walls of the passage 23 are suitably smoothed and rounded at places of intersection to facilitate flow without turbulence. Typically, the angle of bend 156 varies from about 40 to about 45 degrees depending on a specific design requirement. The cross-sectional area of intake 22 is preferably proportional to the cross-sectional area at inlet 24 to an impeller 33 at a ratio varying from about 1.5 to about 2.5:1.

Situated along the intake walls of inlet housing 12 are one or more straightener vanes 154. Directional vanes 154 are spaced radially along the surface of inlet housing 12 so that equal volumes of water may be directed to the periphery of the impeller 33. Vanes 154 minimize radial loads on the impeller 33 for optimized flow efficiency. The vanes 154 also act to dampen any preliminary swirling and turbulence in the inlet water column.

Within passage 23 an intake grill 176 is disposed adjacent the hull opening 22 as seen in FIG. 5. Grill 176 is typically a span of parallel bars disposed lengthwise of the hull 9. The bars of grill 176 have streamlined or hydrofoil cross-section in the direction of the incoming stream to create minimal resistance to water flow. A spacing between bars of grill 176 should preferably not exceed a spacing between diffuser vanes 40 so that the largest objects entering unit 11 may pass through.

If fouling inside housing 12 occurs, an arm-hole duct 100 is provided to enable quick access to passage 23. Duct 100 is situated at bend 156 and comprises a cylindrical housing 101, with an outer flange 102 and a plug 106. Plug 106 is provided With a solid section 104 affixed to a flanged cover 108 which completely fills duct housing 101. Section 104 is provided with a smooth contoured surface 103 that matches the surface section removed from housing 12 in bend 156 when duct 100 is installed. Duct 100, when properly plugged poses of flow disruption. Flange 102 is provided upstanding threaded bolts 109 which are inserted into bolt holes in flange 108 so that plug 106 may be properly aligned when installed. Handle 107 attached to cover 106 provides additional alignment indicia.

A preferred feature of the present invention is a bypass valve assembly 172 fitted in housing 12 near inlet 24 shown in FIG. 1. Excess water is bled through bypass valve assembly 172 if Water pressure between the hull of the vessel 10 and the induction inlet 22 exceeds handling capacity. Excess water buildup known colloquially as balling is a common occurrence in marine jet propulsion units. Occurring at high vessel speeds when the vessel is undergoing sharp maneuvers and/or during rough sea conditions, balling introduces a high drag characteristic upon the hull of vessel 10 and affects the propulsive efficiency of unit 11. The valve assembly 172 functions as an anti-balling device to relieve pressure associated therewith.

The inlet section I is installed in the rear section of the hull so that forward motion of the vessel and subsequent elevation off the surface of the water enables, the intake section I to be positioned slightly below the water level of the craft hull. However, for proper operation at a rest or at low speed, the unit should be installed at least about 60 to 70 percent of impeller 33 cross-sectional area is submerged. Intake section I is bolted, for example, to the hull by means of flange 150.

The impeller section P of the present invention, as seen in FIG. 1, from line A—A to line B—B is shown to incorporate a single stage impeller. The impeller assembly comprises a removable housing 31 made up of two smaller sections, an impeller housing 14 and a diffuser housing 16 having impeller 33 and diffuser 35. Impeller housing 14 is cylindrical with generally uniform diameter at the inlet port 24 and discharge port 26. Diffuser housing 16 is cylindrical with an inside surface tapered inwardly from a maximum diameter adjacent the impeller section I to a minimum diameter adjacent the discharge section D. Convergent inside surface of diffuser housing 16 has an outlet 28 cross-sectional area preferably proportional to the impeller section intake 24 cross-sectional area at a ratio varying from about 0.5 to 0.75:1, preferably at a ratio of about 0.60 to about 0.70:1 and optimally about 0.64:1 so that volumetric displacement of diffuser section is less than volumetric displacement of impeller section. Volumetric displacement of diffuser section is from about 75 to about 90 percent of the volumetric displacement of the impeller section, preferably from about 80 to about 90 percent of the volumetric displacement of the impeller section and optimally about 85 percent. Furthermore, the annular flow channel provided by the axial impeller/diffuser hub combination in impeller housing 31 has smooth substantially contiguous inner and outer surfaces for preventing turbulent boundary eddies. An important design criterion of impeller section P is that the cross-sectional area of the impeller housing 14 and diffuser housing 16 should be the same at the junction point 26.

Figure 16:
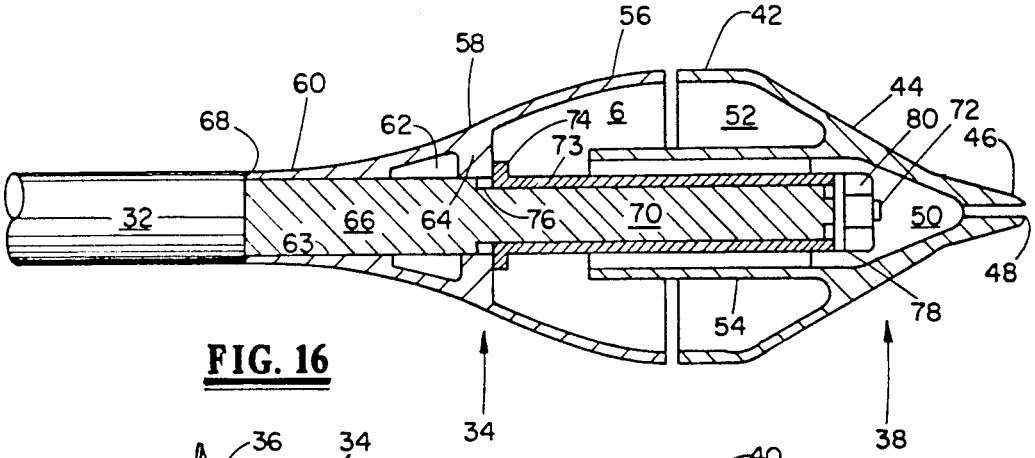
FIG. 16 is a view of a dual hub assembly in longitudinal cross-section.

With particular regard individual parts of impeller section P, the impeller assembly 33 has a unique design having previously undergone much testing and modifications as to both shape of a hub portion 34 and impeller blades 36, see FIGS. 10-12, 14, 16-21. An essential aspect of impeller 33 is that impeller blades 36 are fixed along an outwardly tapered convex surface 58 of the hub portion 34 as seen in FIG. 16, rather than a flat section as is typical in the prior art impeller design.

Figure 14:
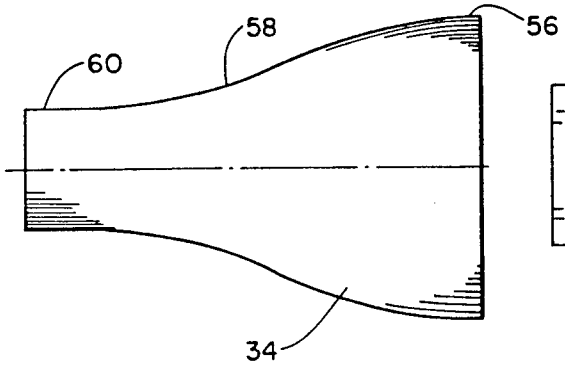
FIG. 14 is an axial view of the rotating hub.

Referring to FIGS. 14 and 16, impeller hub 34 has preferably an outwardly tapered convex surface, and annular interior, more preferably, hub 34 has an outer surface comprising a concave portion and a convex portion when viewed in axial cross-section and an annular interior. Hub 34 has an outer surface with a narrow diameter leading end 60, an increasing variable diameter mid-portion 58 and a large diameter trailing end 56. Distal end 66 of shaft 32 extends through a concentric axial bore 63 the length of hub 34. Leading end 60 has an annular end surface abutting a shoulder 63 on shaft 32 to present a smooth, continuous surface for fluid flow. Annular walls of hub 34 formed by concentric annular cavities 65 and 62 are substantially of constant thickness except for a distal annular end 64 extending outwardly from bore 63 providing an engagable surface for a locking sheath 73.

As seen in FIGS. 10-12 and 17-21, impeller 33 has blades 36 attached along the contoured surface of hub 34 at an inclination designed to maximize blade exposure to the passing fluid and reduce radial acceleration component imparted by impeller 33. Blade 36, referring to FIG. 18, has a convex outer radius 90, a concave inner radius 86, a short trailing edge 88, a long leading edge 84, broad surface sides 92 having a midpoint p, and thickness 91.

The inclination of impeller blades 36 is defined as an average inclination or degree of twist in the length of blades 36 as determined from the perpendicular with respect to a line tangent to the outer surface of the hub 34 at the leading edge 84 and at the trailing edge 88.

Figure 17:
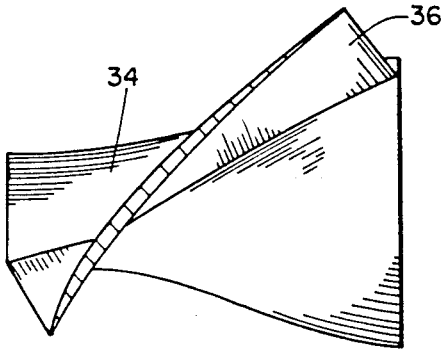
FIG. 17 is a side perspective view of the impeller assembly of FIG. 12 showing one impeller blade attached.
Figure 18:
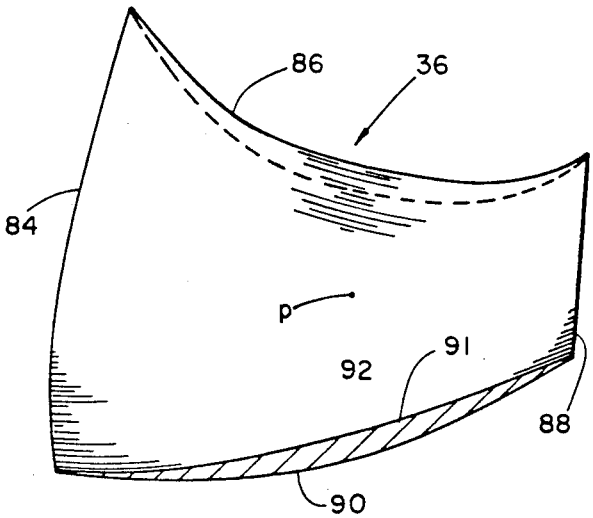
FIG. 18 is a side perspective surface view of an impeller blade.
Figure 20:
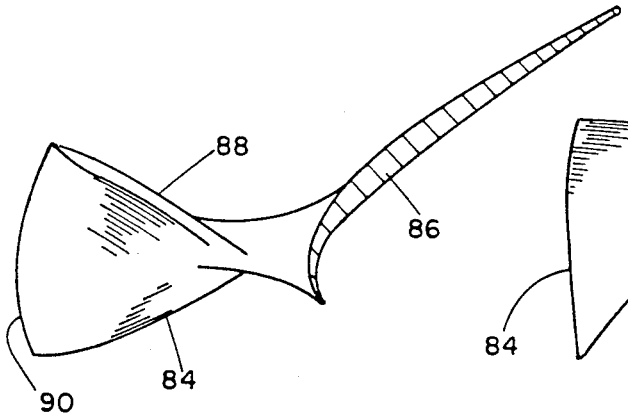
FIG. 20 is a planar perspective view along an edge of the impeller blade showing an inclination in the blade.
Figure 19:
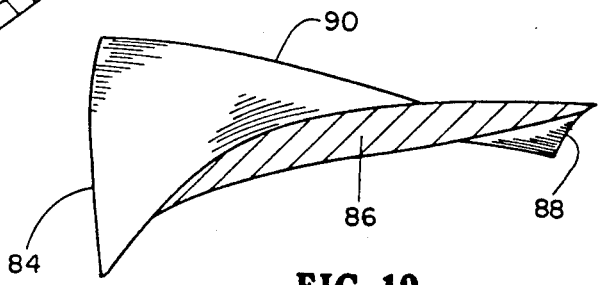
FIG. 19 is a planar perspective view along an inside length of the impeller blade.
Figure 21:
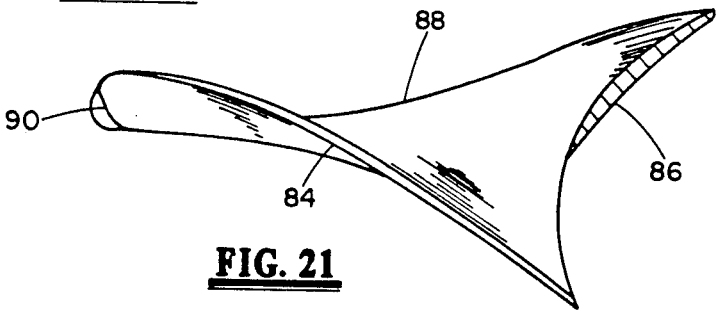
FIG. 21 is a planar perspective view along a second edge of the impeller blade showing the inclination in the impeller blade.

When viewed along either the inner radius 86 or outer radius 90 as seen in FIGS. 17-19 or when viewed down either leading or trailing blade edge, as seen in FIGS. 20 and 21, an average angle of inclination of both leading or trailing edges is preferably in a range from about 20-40 degrees off the perpendicular, more preferably about 30 degrees off the perpendicular with one edge inclined opposite the other as required by blade 36 to follow hub 34 surface contour. The leading edge is twisted into the direction of the advance of the impeller. It will be appreciated the leading edge 84 corresponds to the leading end 60 of hub 34 which has a narrow diameter and the trailing edge 88 corresponds to the trailing end 56 of hub 34 and that the mid-section radial width of blade 36 is a function of the radius of mid-section portion 58 of hub 34 so that impeller 33 diameter is substantially constant. The overall length of blade 36 is equal to the length of hub 34 plus the angular component.

In a radial direction the thickness 91 of blade 36 is substantially uniform. Leading or trailing edges 84 and 88 have substantially uniform tapering with a maximum thickness at a midpoint approximately equidistant from either edge.

Figure 12:
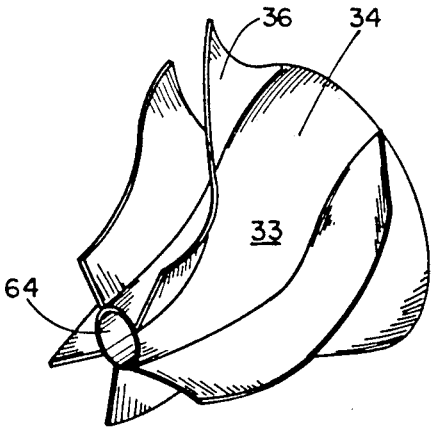
FIG. 12 is an angled perspective view of the impeller assembly.
Figure 13:
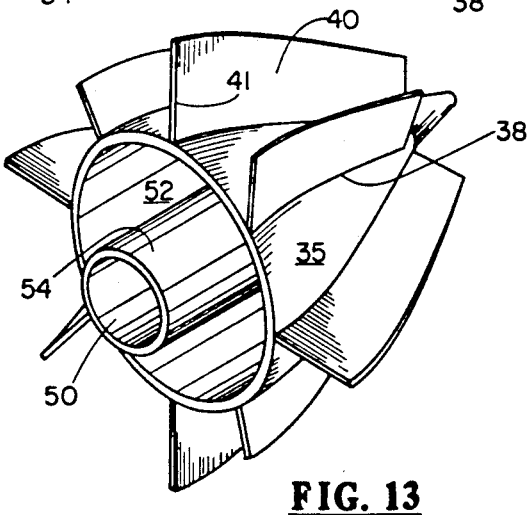
FIG. 13 is a side perspective view of a diffuser vane assembly.
Figure 10:
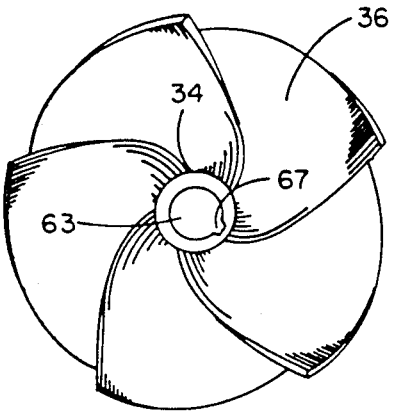
FIG. 10 is a fragmentary perspective view along the lines 10—10 of the unit of FIG. 1 showing the inlet face of an impeller assembly.
Figure 11:
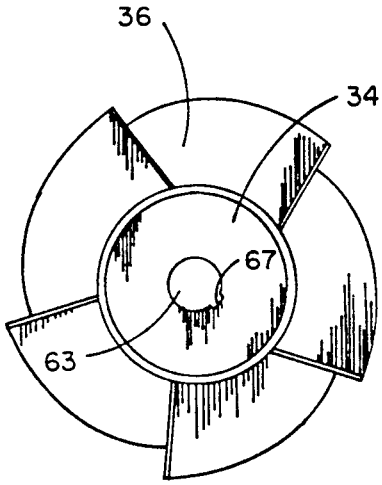
FIG. 11 is a fragmentary perspective view along the lines 11—11 of the unit of FIG. 1 showing the discharge face of the impeller assembly.
Figure 8:
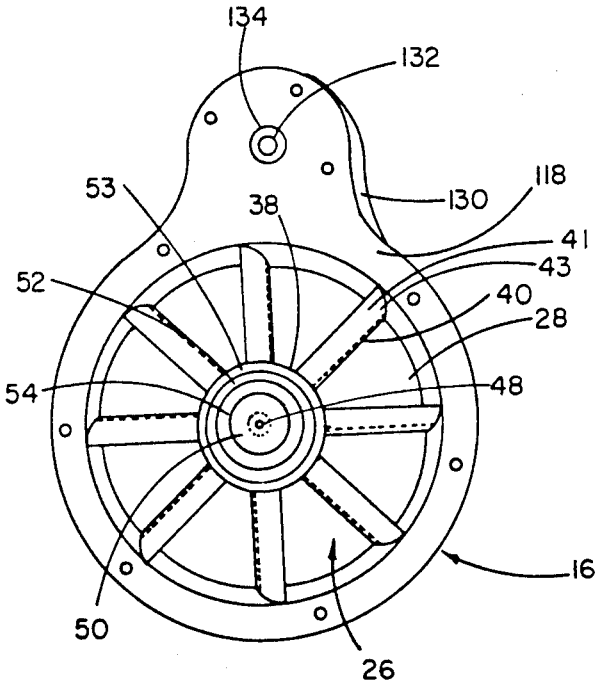
FIG. 8 is a perspective cross-sectional view of the jet propulsion unit in FIG. 1 along the lines 8—8 showing the vane and hub assembly.
Figure 9:
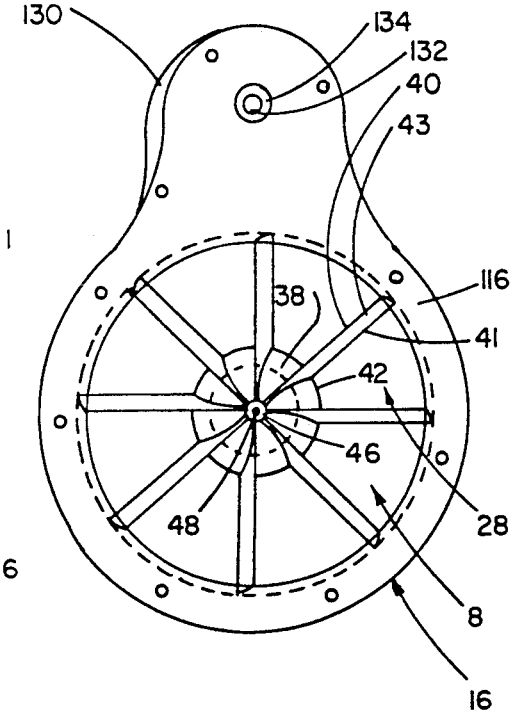
FIG. 9 is a perspective cross-sectional view of the jet propulsion unit of FIG. 1 along the lines 9—9 showing the vane and hub assembly.

FIGS. 10-12 show a typical fan of five blades extending along hub 34, however, the number of blades, impeller diameter and degree of inclination may be optimized in relation to the power supplied by prime mover 13 and design consideration of the vessel at hand.

The diffuser 35, as seen in FIG. 2, FIGS. 8 and 9 and FIG. 14, is disposed immediately adjacent the impeller 33 and is designed to work in conjunction with impeller 33 to achieve several important performance functions: (1) damping a radial acceleration component imparted by the impeller 33; (2) diffusing the path of the water throughput across the entire impeller area cross-section; (3) preventing partial vaporization of the passing fluid resulting from a vacuum associated with impeller action by providing a low artificial back pressure upon impeller 33; and (4) allowing maximum reaction of the impeller and permitting more efficient transfer of the prime movers available energy. Any degree of vapor present would introduce uneven loading on impeller 33 and cavitation.

Figure 15:
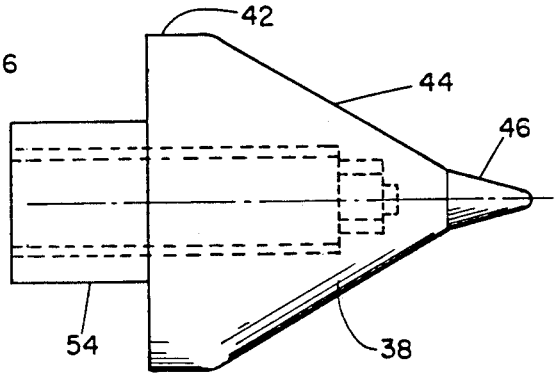
FIG. 15 is an axial view of the stationary hub.

The diffuser hub 38 as seen in FIGS. 15-16, has preferably an inwardly tapered convex surface and annular interior, oppositely disposed in relation to hub 34. Hub 38 comprises a large flat diameter leading end 42, decreasing variable diameter mid-section 44 and a small diameter trailing end 46 forming a rounded nose with a concentric bore 48 drilled through the middle thereof and a central annular end extension 54. Concentric outer annular cavity 52 is primarily for reduction of excess weight providing hub 38 with walls of substantially constant thickness. Concentric inner annular bore 50 through extended portion 54 defines a cylindrical housing for bearing 82. Bore 50 has a reduced diameter in the nose section 46 of hub 38 as required by design strength criteria.

The diffuser blade design is typically based upon standard straight vane design except for significant changes incorporated into vanes 40 associated with the surface contour of diffuser hub 38. The vanes 40 have a radial width which is a function of a diameter of hub 38 so that the diffuser 35 has a constant diameter. The thickness of each blade may be airfoil shaped or typically may have uniform thickness throughout except for an edge side which may be blunted or sharpened as design fine-tuning requires. Vanes 40 have a leading edge 41 which is curved in a direction opposite the directional advance of the impeller 33 and a straight section which is typically perpendicular to the hub surface, yet may also be inclined at an angle of up to about 10 degrees off an orthogonal plane bisecting the hub at point of juncture and opposite the directional advance of the impeller 33 depending on performance fine-tuning. Curved end 41 is typically inclined at an angle of about 10 to about 40 degrees off a longitudinal plane bisecting the hub and incorporating straight portion 43. The vanes 40 are securely affixed lengthwise on one end to the contour surface of hub 38 and on the other to the inside walls of housing 16 and provide girding support for the bearing function of hub 38. The number of diffuser vanes is selected with respect to the number of impeller blades in such a relation that performance criteria of the diffuser section e.g. provides back-pressure and damping of radial acceleration are achieved and that resonance and noise levels are minimized. In an important design feature, the ratio of impellers to diffusers is odd:even or vice versa. For example, given 3, 5, or 7 impeller blades the corresponding number of diffuser vanes would preferably be 6, 8, or 10.

Overall, the diffuser is designed to control the shape of water flow and corresponding acceleration over a large pressure differential presented by a wide range of vessel speeds, maneuvers and sea conditions.

The impeller assembly P, as seen in FIG. 1, is axially symmetrically disposed in the cylindrical impeller housing 31 with the diffuser apparatus 35 attached rearward of the impeller apparatus 33 in close proximity. The outer surface of trailing end 56 on rotatable hub 34 is substantially continuous with the outside surface of leading end 42 on fixed hub 38 as seen in FIG. 16. Impeller assembly P is so arranged to make this assembly simple and quick and to enable mating of the impeller and matched diffuser to prime mover 13 and craft design requirements. Impeller housing 14 may have a replaceable sleeve 170 enabling the diameter of housing 14 be reduced corresponding to reduction of impeller 33 diameter. Thus a smaller diameter impeller arrangement can be used for smaller boats. There is, however, no limitation regarding HP or vessel size and unit 11 may have proportionally expanded capacity for large ships or for greater speeds.

Impeller shaft 32 extending axially through unit 11 is provided with a first bearing support by bearing assembly 140 mounted on inlet housing and a second bearing support at fixed hub 38. Bearing assembly 140 includes housing 142, roller bearing 144 and locking ring 146. Bearing assembly 140 may also include a gear housing (not shown) for unit gearing to a particular prime mover requirement.

Shaft 32, as seen in FIG. 16, is provided with a shoulder 68 and a concentric distal section 66 which has progressively smaller concentric diameter sections 70 and 72. Impeller 33 slides onto section 66 of shaft 32 so that the annular end of leading edge 60 on hub 34 abuts shoulder 68 to present a smooth continuous surface for fluid flow. An annular locking sleeve 73 with a proximal annular end 74 having greater diameter than a minimal diameter of the distal annular end 64 extending outwardly from hub bore 63 engages the annular end 64 holding impeller 33 securely against shoulder 68 on shaft 32. A washer 78 and locking nut so secure sleeve 73. Distal section 72 of shaft 32 is threaded for locking nut so.

A standard key (not shown) and keyway 67 combination synchronously engage impeller 33 upon shaft 32.

The bearing sleeve 82 is inserted into the center annular portion 54 of hub housing 38. Assembly is completed by inserting shaft portion 70 having the sleeve 73 through bearing 82 so that clearance between hubs 34 and 38 is about ⅛ inch. Bore 48 in the nose end 46 of stationary hub 38 provides an exit for water flushing around the exterior of bearing 82. The bearing 82 is self-lubricating, self-cooling and self-flushing, typical of bearings used in marine application.

A means for joining impeller section casing 14 to intake housing 12 and a nozzle housing 20 to discharge housing 18 comprises identical ring clamps 110 which are tightened by bolts 113 within the clamp fitting over mated flanges 112 affixed to respective sections. The clamp 110 typically comprises two semicircular grooved pieces attached at a hinge 111. Additional joining means comprise matching flange connectors as between impeller housing 14 and diffuser housing 16 utilizing flanges 114 and 116 and diffuser casing 16 and discharge casing 18 utilizing flanges 118. A preferably rubber seal 115 is utilized in between. Rubber seal 115 is typically an O-ring or gasket.

Design of unit 11 is such that the steering means a with housing 130 sits centrally atop pump housing section 31. Sections of housing 130 are also joined by flanges 114, 116 and 118.

Figure 7:
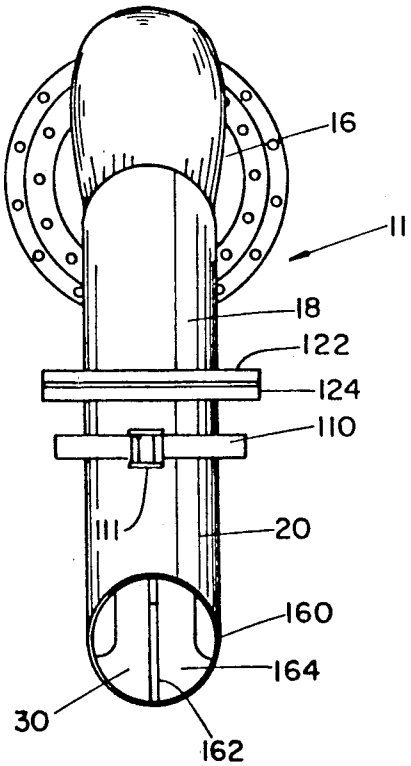
FIG. 7 is a back perspective view of the pump and discharge section of the jet propulsion unit in FIG. 6 along the line 7—7.
Figure 6:
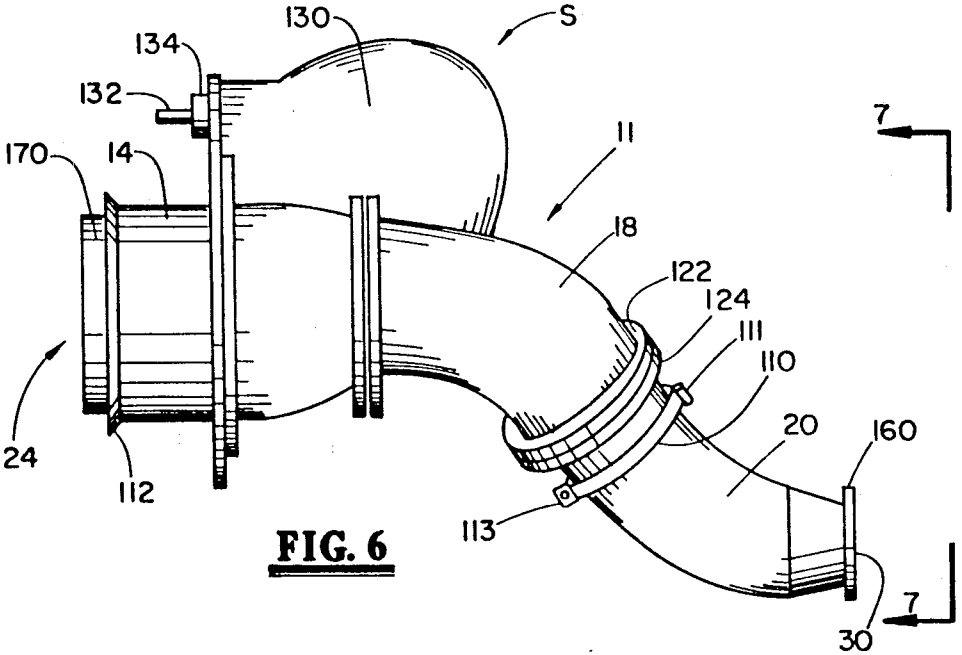
FIG. 6 is a side perspective view of the pump and discharge sections of the jet propulsion unit of the present invention.

As seen in FIGS. 1, 6, and 7, an outlet or discharge section D extending from line C—C to line E—E comprises three cylindrical sections 18, 19 and 20 and provides two primary functions: fluid acceleration and a means for swivelably directing the exiting stream to provide control means. Discharge section D incorporates complementary angles of preferably 45 degrees in order that a discharge point 30 is horizontally aligned with bottom hull 9 of craft 10.

The first section extending midway out from line C—C is angled cylindrical housing 18. Housing 18 comprises a swivelable portion 19 which is swivelable horizontally through 360 degrees. Swivelable second section 19 and angled section 18 are joined by bearing assembly 120. Bearing assembly 120 comprises inner race 122 attached to the exterior surface of housing 18, outer race 124 attached to the exterior surface of section 19 and bearing ring 121 therebetween.

Steering means S links the steering column 15 in a marine vessel to rotatable section 19 of the jet propulsion unit of the present invention. Steering linkage comprises a steering rod 132 having a sleeve bearing 134 and a first and second angular gear 136. Second angular gear 136 mounted atop a steering rod 138 angularly extending through the interior of housing 18 is operatively associated with rotating section 19 by means of spoke vanes 137. Angle spoke vanes 137 are designed and installed so as not to present an impediment to flow.

The third section of discharge D is complementary angled housing 20 clamped to section 19 as mentioned previously and extending out to line E—E. Housing 20 includes nozzle 21 and is designed to be interchangeable to enable performance guided selection of nozzle 21. The cross-sectional area at nozzle outlet 30 in discharge section D is preferably proportional to impeller inlet 24 cross-sectional area at a ratio from about 0.25 to about 0.50:1, preferably a ratio from about 0.30 to about 0.40:1 and optimally about 0.35:1. Interior surfaces of discharge nozzle 21 are smooth and convergent onto outlet 30 cross-sectional area.

Nozzle 21 includes one or more straightener Vanes 162 preferably affixed perpendicularly to the inner surface of section Straightener vanes 162 are designed dampen swirl and enable a steady laminar column of water throughput to be discharged from unit 11. In addition, nozzle 21 comprises a ring 160 attached to the outer edge of nozzle 21. Ring 160 artificially enhances the propulsive reaction of the water being discharged through the nozzle 21 by means of eddies around the edges of ring 160 to permit a smoother transition of the exiting water.

Discharge housing 18 also includes a bleeder hole 174 bored approximately in line with the end of diffuser hub 38 so that trapped air introduced into unit 11 may escape and unit 11 be self-priming.

The control function of discharge section D is incorporated by the directing of nozzle thrust as provided by the steering apparatus S. Directional headings are associated with operation of nozzle 21 in position F, R, and radial positions in between.

The marine jet propulsion unit of the present invention is preferably fabricated and assembled from stainless steel chosen for its strength and resistance to corrosion properties, however, a noncorroding engineering plastic having good cohesive strength would also be suitable for one or more parts of the propulsion unit.

It will be appreciated that the performance of the marine jet propulsion unit 11 is dependent upon the synergistic interrelation of the function of each individual section. Each individual section must be manufactured and assembled portionally and symmetrically with consideration given to required pressure and flow balance needed to permit the jet propulsion unit to function efficiently.

Predictability of performance in regards to the power requirements of the jet propulsion unit enables the unit to be fine-tuned to a particular prime mover respecting design criteria of the impeller blades, associated diffuser vanes and nozzle.

The foregoing description of the invention is illustrative and explanatory thereof. Various changes in the materials, apparatus, and particular parts employed will occur to those skilled in the art. It is intended that all such variations within the scope and spirit of the appended claims be embraced thereby.

I claim:

1. A jet propulsion unit for a marine craft, comprising:

a converging intake section having convergently tapered walls for receiving water from adjacent the unit, said walls having a smooth surface to inhibit turbulence;

an impeller section for increasing the energy of water from said intake section;

a diffuser section for promoting axial flow of water from said impeller section;

a swivelable discharge section for discharging water from said diffuser section as a directional water jet;

a cylindrical housing disposed in said impeller section having an inner surface of generally uniform diameter;

a rotatable hub concentrically disposed in said cylindrical housing and having an outer surface when viewed in axial cross-section comprising a concave portion and a convex portion, and an outer diameter increasing from a minimum adjacent said intake section to a maximum adjacent said diffuser section;

a plurality of radially spaced impeller blades affixed on said outer surface of said rotatable hub and extending outwardly from said hub outer surface to adjacent said cylindrical housing inner surface, said blades being inclined at an angle with respect to a longitudinal axial plane of said rotatable hub to reduce a radial acceleration component of a passing water flow;

an inside surface disposed in said diffuser section tapered inwardly from a maximum diameter adjacent said impeller section to a minimum diameter adjacent said discharge section;

a fixed hub concentrically disposed in said diffuser section and having a convex outside surface tapered from a maximum diameter adjacent said impeller section to a distal terminus adjacent said discharge section, said fixed hub outside surface and said inside surface defining an annulus in said diffuser section having a generally converging cross-sectional area;

a plurality of radially spaced diffuser vanes extending from said fixed hub outside surface to said diffuser section inside surface, said diffuser vanes having at least a distal portion being parallel to a longitudinal axis of said fixed hub adjacent said discharge section;

a bearing disposed between said rotatable hub and said fixed hub;

means for rotating said rotatable hub with respect to said fixed hub.

2. The propulsion device of claim 1, wherein said intake section includes an arm-hole duct upstream said impeller and a removable plug piece having an outer flange and an inner core end wherein said core end has a contour surface corresponding with a wall of said intake section to present a generally smooth, continuous surface for fluid flow therethrough.

3. The unit mechanism of claim 1, wherein said intake section further comprises one or more straightener vanes securely affixed along an inside contour surface.

4. The propulsion unit of claim 1, wherein a transverse inlet cross-sectional area of said intake section is proportional to an inlet cross-sectional area of said impeller section at a ratio of from about 1.5 to about 2.5:1.

5. The propulsion unit of claim 1, wherein an outlet cross-sectional area of said diffuser section is proportional to an inlet cross-sectional area ratio of said impeller section at a ratio of from about 0.50 to about 0.75:1.

6. The propulsion unit of claim 5, wherein said outlet:inlet cross-sectional area ratio of said diffuser:impeller sections is from about 0.60 to about 0.70:1.

7. The propulsion unit of claim 1, wherein a bypass valve is positioned upstream of said impeller blades for inhibiting balling.

8. The propulsion unit of claim 1, wherein said maximum outside diameter of said outer surface of said rotatable hub is substantially equivalent to said maximum outside diameter of said outside surface of said fixed hub.

9. The propulsion unit of claim 1, wherein said rotatable hub is slightly spaced from said fixed hub to present a substantially continuous surface for fluid flow.

10. The propulsion unit of claim 1, wherein said rotatable hub is mounted on a concentric shaft.

11. The propulsion unit of claim 10, wherein said shaft is received in a concentric bore formed through said rotatable hub, said shaft having a shoulder engaging a proximal annular end surface of said rotatable hub extending outwardly from said bore to said outer surface adjacent said minimum outside diameter, wherein said shoulder abuts said rotatable hub to present a smooth, continuous surface for fluid flow.

12. The propulsion unit of claim 10, wherein said shaft extends from said rotatable hub into a concentric bore formed in a proximal end of said fixed hub, and an annular bearing is disposed between an exterior surface of said shaft extension and an interior surface of said fixed hub bore.

13. The propulsion unit of claim 1, wherein said discharge section comprises a removable nozzle attached to a housing by a quick connect fitting.

14. The propulsion unit of claim 10, wherein said rotatable hub has a distal annular end surface spaced from a proximal annular end surface and extending outwardly from a rotatable hub bore, further comprising a locking sleeve disposed on a shaft extension between an exterior surface thereof and said annular bearing, said shaft extension terminating in a threaded projection receiving a locking nut, said locking sleeve having a first end with an outside diameter greater than a minimum diameter of said distal annular end surface and in engagement therewith, and a second end engaged by said locking nut.

15. The propulsion unit of claim 14, wherein said locking nut has a maximum outside diameter less than or equal that of said locking sleeve.

16. The propulsion mechanism of claim 13, wherein said nozzle is swivelable through 360°.

17. The propulsion unit of claim 13, wherein said nozzle comprises a solid ring affixed to a discharge end of said discharge section.

18. The propulsion unit of claim 1, wherein said discharge section further comprises one or more straightener vanes securely affixed to a nozzle inner surface.

19. The propulsion mechanism of claim 1, wherein said discharge section further comprises spoke vanes attaching a steering means to said discharge section.

20. The propulsion unit of claim 1, wherein an outlet cross-sectional area of said discharge section is proportional to an inlet cross-sectional area of said impeller section at a radio of from about 0.25 to about 0.50:1.

21. The propulsion unit of claim 20, wherein said ratio of outlet:inlet cross-sectional areas is from about 0.30 to about 0.40:1.

22. The propulsion unit of claim 1, wherein said cylindrical housing is interchangeable and said impeller section further comprises a sleeve disposed between said inside diameter of said impeller section and said impeller blades.

* * * * *